US008869483B2

(12) United States Patent
Amend

(10) Patent No.: US 8,869,483 B2
(45) Date of Patent: Oct. 28, 2014

(54) INSULATING CORNER WALL FORM

(71) Applicant: Victor Amend, Toronto (CA)

(72) Inventor: Victor Amend, Toronto (CA)

( * ) Notice: Subject to any disclaimer, the term of this patent is extended or adjusted under 35 U.S.C. 154(b) by 0 days.

(21) Appl. No.: 13/915,060

(22) Filed: Jun. 11, 2013

(65) Prior Publication Data

US 2013/0327918 A1 Dec. 12, 2013

Related U.S. Application Data

(60) Provisional application No. 61/658,384, filed on Jun. 11, 2012.

(51) Int. Cl.
*E04B 2/86* (2006.01)

(52) U.S. Cl.
CPC ..... *E04B 2/8617* (2013.01); *E04B 2/8647* (2013.01); *E04B 2002/867* (2013.01)
USPC ..... 52/426; 52/275

(58) Field of Classification Search
CPC ..... E04B 2/86; E04B 2/8611; E04B 2/8617; E04B 2/8635; E04B 2/8641; E04B 2/8647; E04B 2002/84; E04B 2002/86; E04B 2002/867; E04G 11/02; E04G 11/06; E04G 17/001; E04G 17/06
USPC ..... 52/275, 276, 279, 426; 249/194
See application file for complete search history.

(56) References Cited

U.S. PATENT DOCUMENTS

| | | | | | |
|---|---|---|---|---|---|
| 1,650,485 | A * | 11/1927 | Blank | 52/274 |
| 2,540,622 | A * | 2/1951 | Langenberg | 52/293.3 |
| 2,877,874 | A * | 3/1959 | Meyer | 52/275 |
| 3,184,013 | A * | 5/1965 | Pavlecka | 52/275 |
| 4,866,891 | A * | 9/1989 | Young | 52/105 |
| 6,691,481 | B2 * | 2/2004 | Schmidt | 52/425 |
| 7,730,688 | B2 * | 6/2010 | Pfeiffer | 52/426 |
| 2009/0308011 | A1 * | 12/2009 | Philippe | 52/426 |

* cited by examiner

*Primary Examiner* — Michael Safavi

(57) ABSTRACT

An insulating corner wall form comprises inner and outer foam panels arranged to provide a fixed space therebetween for receiving the poured concrete, the fixed space comprising a corner of about 90 degrees; a plurality of ties connecting the inner and outer panels. The ties comprise first and second corner ties, each extending from a respective first location at the inner panel to a respective second location at the outer panel. Each second location is a distance from a panel corner of the outer panel of from about 20% to about 80% of the thickness of the fixed space between opposite parallel portions of the inner and outer panels.

12 Claims, 7 Drawing Sheets

INSULATING CORNER WALL FORM

CROSS-REFERENCE TO RELATED APPLICATIONS

This application claims the benefit of U.S. Application No. 61/658,384 entitled "CORNER WALL FORM" and filed on Jun. 11, 2012, the content of which is incorporated herein by reference in its entirety.

FIELD OF THE INVENTION

The present invention relates generally to building structures and in particular, to an insulating corner wall form.

BACKGROUND OF THE INVENTION

In the field of building and construction, concrete walls, concrete floors, and concrete roofs are often formed by molding poured concrete using insulating forms. Insulating wall forms typically comprise a pair of spaced, vertical panels that define a volume into which liquid concrete is poured and allowed to set. The insulating wall forms may be removed once the concrete has set, or alternatively may be left in place.

Insulating wall forms have been previously described. For example, U.S. Pat. No. 6,536,172 to Amend discloses an insulating construction form consisting of a pair of spaced apart panels and a plurality of ties. Tie members include pairs of resilient retainer arms, which define a series of adjacent receptacles. A reinforcing bar is typically inserted into the receptacles, and its displacement therefrom is inhibited by abutment surfaces. Markings are positioned on each panel to guide the attachment of a cladding.

Insulating wall forms used to form wall sections having a corner typically comprise an inner panel and an outer panel, where each of the panels has a respective panel corner, and where the panels are spaced to define a volume into which liquid concrete is poured and allowed to set. However, certain challenges arise during use of conventional insulating corner wall forms. For example, when liquid concrete is poured into the form, the liquid concrete flows in a direction that is perpendicular to a concrete-facing surface of the outer panel in the region of the corner. As will be appreciated, the weight of the flowing concrete exerts a significant impact force on this concrete-facing surface of the outer panel, and can continue to exert force on the outer panel as it makes its way around the corner. These forces can cause the outer panel to bulge outwardly, shift and/or blow out (that is to crack and break into pieces), causing the form to fail.

Internal ties for providing rigidity to insulating corner wall forms are known. For example, U.S. Pat. No. 7,861,479 to Crosby et al. discloses a form for poured concrete walls having a corner bracket that includes an outer, horizontal strap with generally vertical strips attached thereto or molded therewith for encapsulation in the outside, and optionally the inside, foam panels of the form.

U.S. Patent Application Publication No. 2008/0155925 to Pfeiffer discloses a corner bracket member for use in an insulated concrete form corner block or other form assembly having a pair of opposed inner and outer spaced apart panels for receiving concrete therebetween. The corner bracket member includes at least a pair of side members, each side member having at least a pair of spaced apart flange members adapted for receiving and anchoring exterior facade or other surfaces thereto, and at least one concrete engaging member positioned and located so as to extend in a direction completely across the space formed by and between the inner and outer panels associated with the insulated concrete form corner block. The side members and flange members of the corner bracket member are encapsulated within one of the inner and outer panels, and the at least one concrete engaging member includes a terminal end portion which is encapsulated within the other of the inner and outer panels when attached thereto.

U.S. Patent Application Publication No. 2007/0175155 to Cymbala et al. discloses a form for use in a concrete wall forming system to define wall sections meeting an intersection region. The form comprises panels arranged in a spaced relationship to each other to define therebetween a volume for each wall section and an intersection volume for the intersection region, and a series of ties forming a stack of ties. Each tie has an exterior frame having at least three sides, corners where two adjacent sides meet and a web member spanning generally across an interior volume within the frame. Each tie is located in the intersection region with two sides spanning between opposing sides of opposing panels and has each corner embedded within a panel.

U.S. Patent Application Publication No. 2009/0308011 to Philippe discloses an insulated concrete form panel reinforcement. The insulated concrete form comprises a main panel, a reinforcement on the main panel for stiffening the main panel, a spacer retention element integrated in the reinforcement for securing a spacer to the panel, and a first opposing panel opposite the main panel and having a first opposing spacer retention element integrated therein for securing the spacer to the first opposing panel. The insulated concrete form panel reinforcement is particularly useful at high stress locations, such as at T-wall intersections.

Deficiencies of prior art insulating corner wall forms comprising internal ties are known. For example, FIG. 1A shows a prior art insulating corner wall form, which is generally indicated by reference numeral 20. Form 20 comprises an inner panel 22 and an outer panel 24. Each of the panels 22 and 24 is fabricated of molded foam, such as for example of expanded polystyrene (EPS). The inner panel 22 is spaced from the outer panel 24 so as to provide a fixed space, or a volume 26, therebetween for receiving a charge of poured concrete (not shown). The form 210 also comprises a plurality of longitudinal ties 32 connecting the inner panel 22 and the outer panel 24, and which span the fixed space. Each tie 32 is terminated by a pair of flanged ends 36, with each flanged end 36 being embedded within a respective one of the inner panel 22 and the outer panel 24 during molding of that panel. The form 20 further comprises an internal corner bracket 38 that is integral with the outer panel 24, and which has a corner tie 42 connected thereto and extending therefrom. The corner tie 42 is terminated by a flanged distal end 44 that is embedded within the inner panel 22.

In use, when concrete is poured into the volume 26 of the form 20, the corner tie 42 provides resistance to bulging of the outer panel 24 away from the inner panel 22 under forces associated with the weight of the concrete. However, as will be understood, the large area of each concrete-facing surface of the outer panel 24 between the corner tie 42 and each adjacent tie 32 renders the outer panel 24 susceptible to rupture or breaking. In the event of a break, the broken corner piece, now otherwise disconnected from the outer panel 24, can pivot about the single attachment point of the corner tie 42 at the inner panel 22, causing the form 20 to fail.

FIG. 1B shows another prior art insulating corner wall form, which is generally indicated by reference numeral 60. Form 60 comprises an inner panel 62 and an outer panel 64. Each of the panels 62 and 64 is fabricated of molded foam, such as for example of expanded polystyrene (EPS). The inner panel 62 is spaced from the outer panel 64 so as to provide a fixed space, or a volume 66, therebetween for receiving a charge of poured concrete (not shown). The form 60 also comprises a plurality of longitudinal ties 72 connecting the inner panel 62 and the outer panel 64, and which span the volume 66. Each tie 32 is terminated by a pair of flanged ends (not shown), with each flanged end being embedded within a respective one of the inner panel 62 and the outer panel 64 during molding of that panel. The form 60 further comprises a webbed corner tie 80 comprising a center tie 82 and two (2) peripheral ties 84, with each peripheral tie 84 being adjacent the center tie 82. The corner tie 80 has a flanged connector (not shown) that is embedded within the inner panel 62, and each of the center tie 82 and the peripheral ties 84 is terminated by a flanged distal end (not shown) that is embedded within the outer panel 64.

In use, when concrete is poured into the volume 66 of the form 60, the corner tie 80 provides resistance to bulging of the outer panel 64 away from the inner panel 62 under forces associated with the weight of the concrete. However, as the peripheral ties 84 are spaced from the center tie 82 on the concrete-facing surface of the outer panel 64 by a distance that generally corresponds to the distance spanned by each tie 72, there exist two large unreinforced regions on the concrete-facing surface of the outer panel 64. These large unreinforced regions bear a great deal of the force from the weight of poured concrete flowing through the volume 66, because they are directly in-line with the flow of poured concrete. As a result, the outer panel 64 at these unreinforced regions is greatly susceptible to cracking or breaking during concrete pouring. In the event of a break, the broken corner piece, now otherwise disconnected from the outer panel 64, can pivot about the single attachment point of the corner tie 80 at the inner panel 62, causing the form 60 to fail.

Improvements are generally desired. It is therefore an object of the present invention at least to provide a novel insulating corner wall form.

SUMMARY OF THE INVENTION

Accordingly, in one aspect there is provided an insulating corner wall form comprising: inner and outer foam panels arranged to provide a fixed space therebetween for receiving the poured concrete, the fixed space comprising a corner of about 90 degrees; a plurality of ties connecting the inner and outer panels, the ties comprising: first and second corner ties each extending from a respective first location at the inner panel to a respective second location at the outer panel, each second location being a distance from a panel corner of the outer panel of from about 20% to about 80% of the thickness of the fixed space between opposite parallel portions of the inner and outer panels.

The first locations may be on opposite sides of a panel corner of a concrete-facing surface of the inner panel.

The second locations may be on opposite sides of the panel corner of a concrete-facing surface of the outer panel.

Each second location may generally coincide with a line that generally bisects the fixed space between opposite parallel portions of the inner and outer panels.

Each second location may be a distance from the panel corner of the outer panel of from about 40% to about 60% of the thickness of the fixed space between opposite parallel portions of the inner and outer panels.

Each second location may be a distance from the panel corner of the outer panel of about 50% of the thickness of the fixed space between opposite parallel portions of the inner and outer panels.

At least one of the ties may be embedded within a respective one of the inner and outer panels during molding of that panel.

At least one of the ties may comprise a longitudinal body terminated by a pair of flanged ends. The at least one tie may have a unitary construction. The at least one tie may have a non-unitary construction. For the at least one tie, one or more of the longitudinal body and the flanged ends may be removably connectable to each other. Each flanged end may be embedded within a respective one of the inner and outer panels. The at least one tie may be embedded within the inner panel such that a distal surface of said at least one tie is accessible from the outwardly-facing surface of the inner panel. The at least one tie may be embedded within the outer panel such that a distal surface of said at least one tie is accessible from the outwardly-facing surface of the outer panel.

The inner and outer panels may be fabricated of expanded polystyrene (EPS). At least one of the ties may be fabricated of high-impact polystyrene (HIPS).

BRIEF DESCRIPTION OF THE DRAWINGS

Embodiments will now be described more fully with reference to the accompanying drawings in which.

DETAILED DESCRIPTION OF THE EMBODIMENTS

Figure 1A:
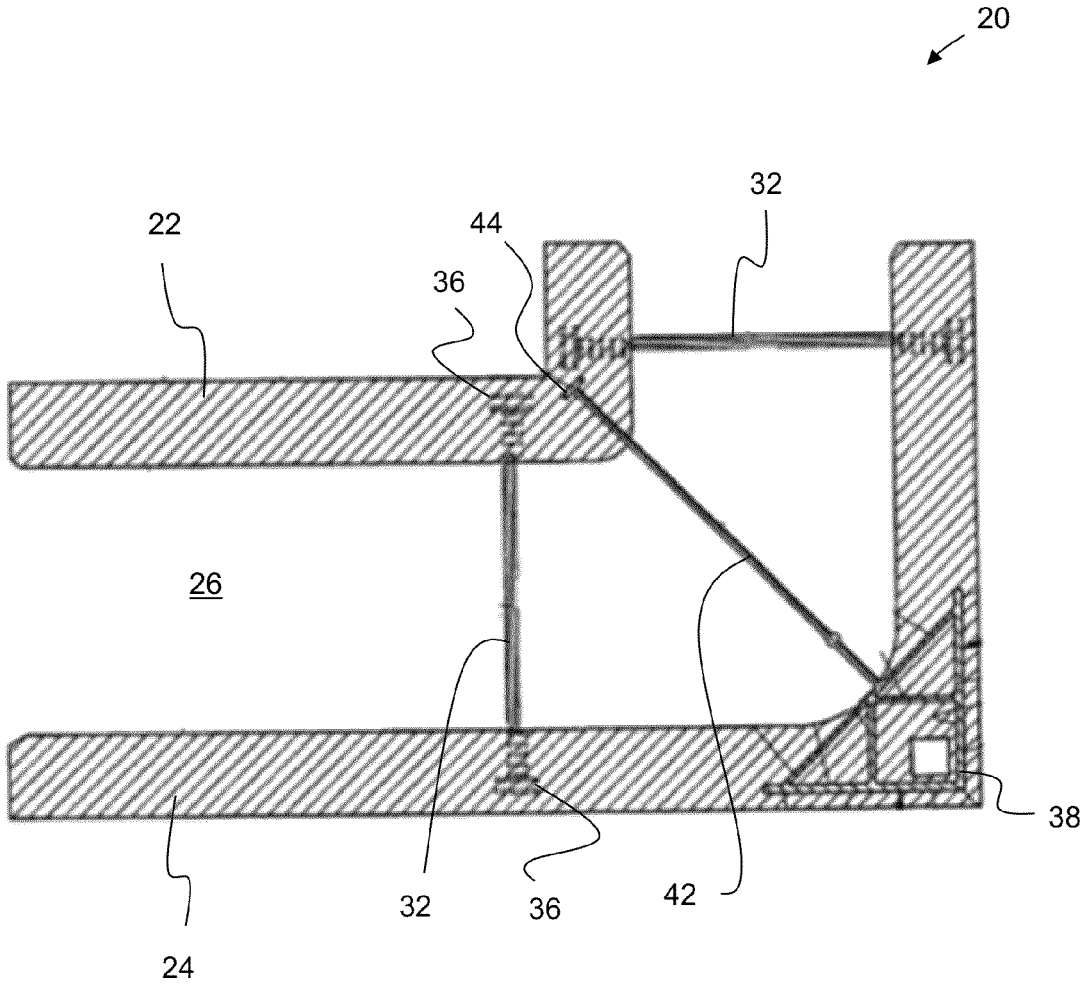
Figure 1A (PRIOR ART)
FIGS. 1A and 1B are plan views of prior art insulating corner wall forms.
Figure 1B:
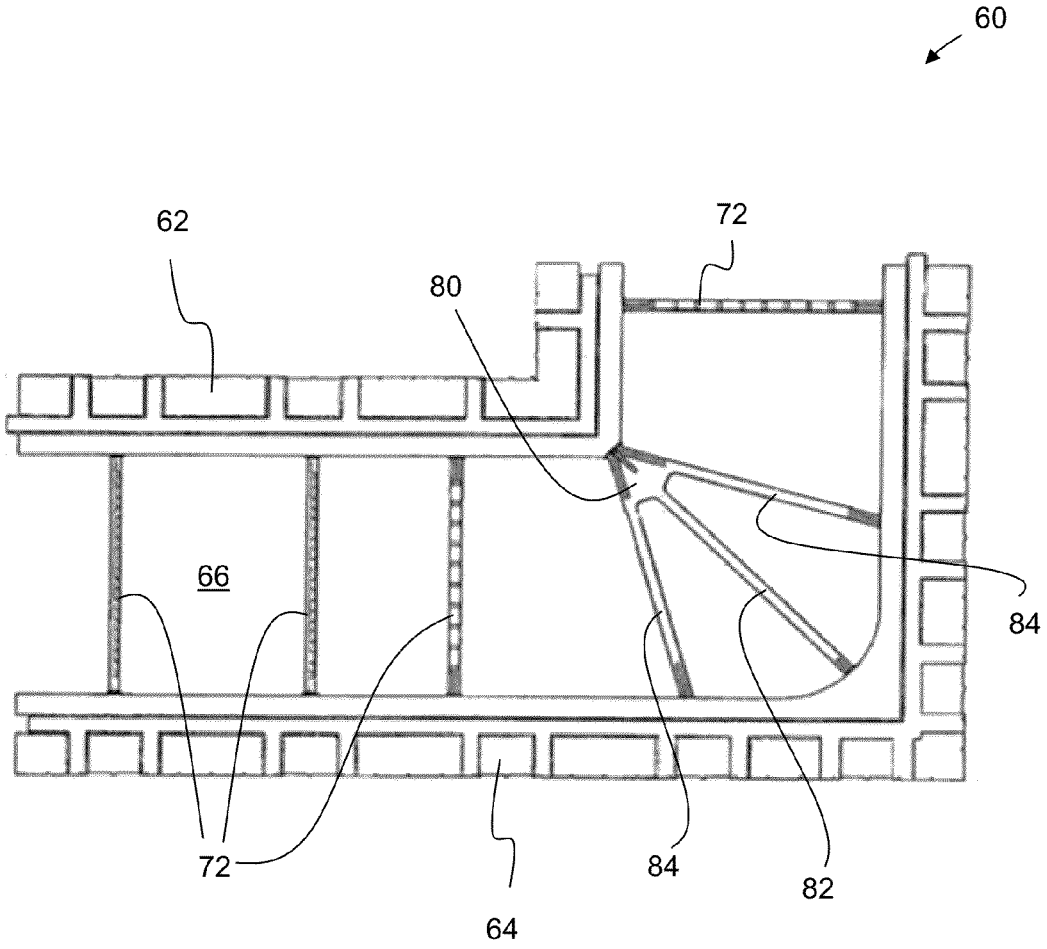
Figure 1B (PRIOR ART)
Figure 2:
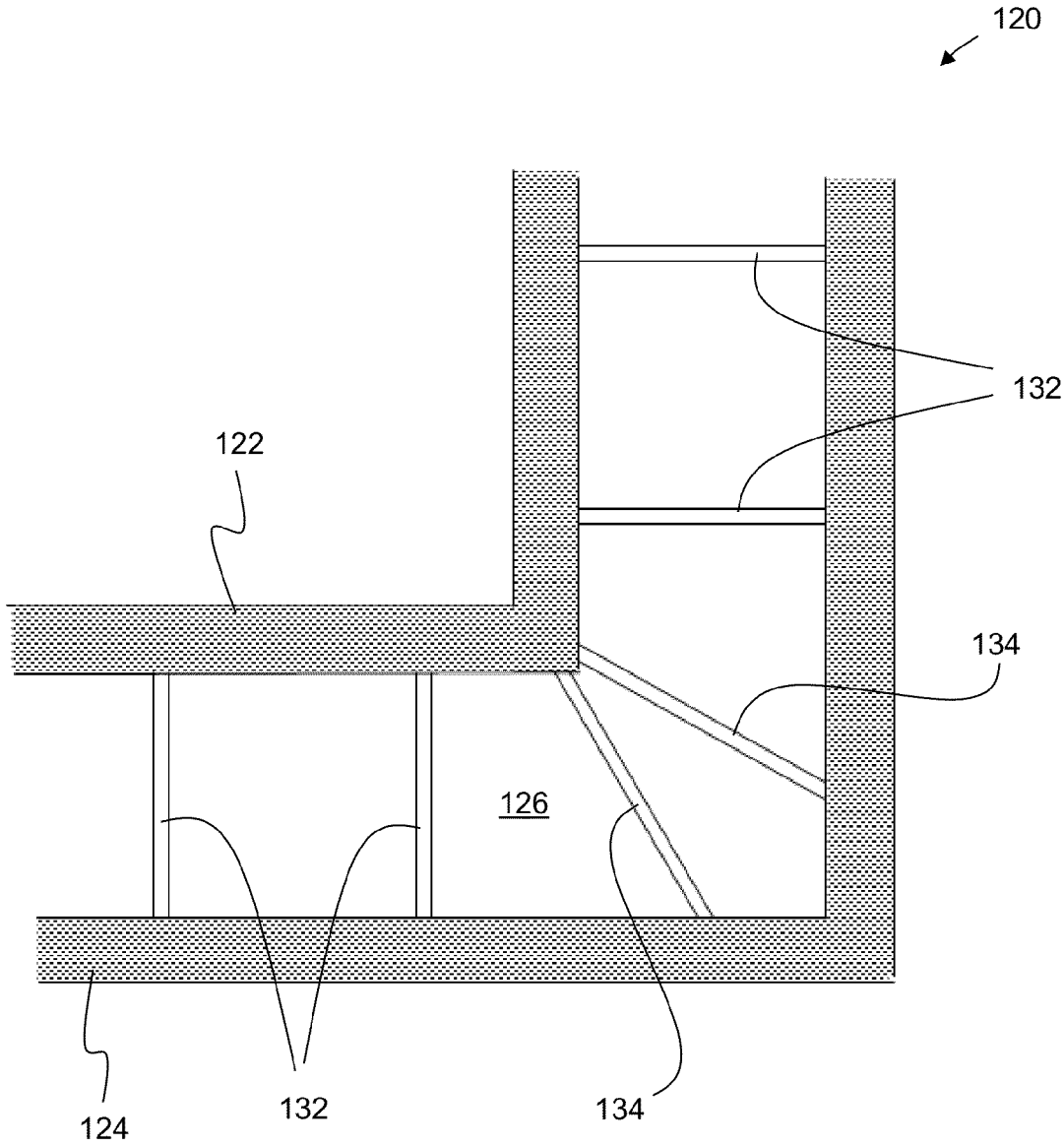
FIG. 2 is a plan view of an insulating corner wall form.

Turning now to FIGS. 2 to 5, an insulating corner wall form is shown and is generally indicated by reference numeral 120. Form 120 is configured for receiving poured concrete (not shown) for construction of a concrete wall portion (not shown) comprising a corner. Form 120 comprises an inner panel 122 and an outer panel 124 that are connected to each other by a plurality of longitudinal ties. The inner panel 122 and outer panel 124 cooperate to form a corner having an angle of about 90 degrees. It will be understood that the terms "inner panel" and "outer panel" refer to the geometrical position of each panel relative to the corner, and not necessarily to the position of the panel relative to an interior surface or exterior surface of the constructed concrete wall portion.

Each of the panels 122 and 124 is fabricated of foam, and in this embodiment each of the panels 122 and 124 is fabricated of expanded polystyrene (EPS) by molding. In this embodiment, each panel 122 and 124 has a unitary construction, and comprises two (2) linear portions that intersect to form a panel corner. As may be seen, parallel portions of the inner panel 122 and outer panel 124 are spaced from each other by a distance 2*a*, so as to define a fixed space, or a volume 126, therebetween for receiving the poured concrete. As will be understood, the distance 2*a* between the inner panel 122 and the outer panel 124 corresponds to the thickness of the volume 126, and therefore the thickness of the constructed concrete wall portion.

The ties connecting the inner panel 122 and the outer panel 124 comprise a plurality of ties 132 that are positioned along the parallel portions of the panels 122 and 124, and a plurality of corner ties 134 that are positioned adjacent the panel corners of the panels 122 and 124. In this embodiment, each of the ties 132 and 134 has a longitudinal shape having two (2) ends, with each end being embedded within, and therefore encapsulated within, a respective one of panels 122 and 124 during molding of that panel. As will be understood, there may be additional ties (not shown) similarly positioned along the height of the panels 122 and 124 (that is, in the direction normal to the page).

Figure 3:
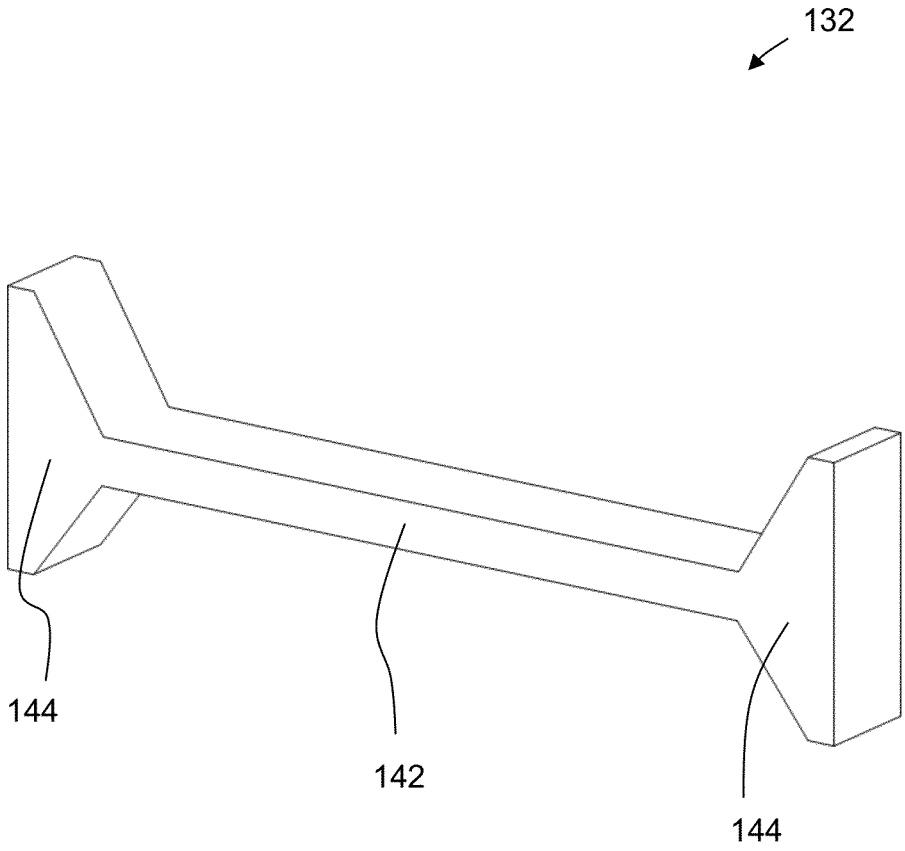
FIG. 3 is a perspective view of a tie forming part of the insulating corner wall form of FIG. 2.

One of the ties 132 may be better seen in FIG. 3. In this embodiment, each tie 132 has a unitary construction, and is fabricated of injection molded high-impact polystyrene (HIPS). As will be understood, fabricating the tie 132 of HIPS enables the tie 132 to more readily fuse to the EPS panels 122 and 124 during molding, so as to provide a high-strength bond at the HIPS-EPS interface. Each tie 132 comprises a linear, longitudinal body 142 that is terminated by a pair of flanged ends 144. Each flanged end 144 comprises at least a portion that extends outwardly from the body 142, and in the embodiment shown each flanged end 144 comprises two portions that extend outwardly from the body 142. As will be understood, the shape of the flanged end 144 allows the tie 132 to be anchored within the panel 122 or 124, for enabling the tie 132 to remain secured to the panel 122 or 124 when subjected to forces that arise during concrete pouring.

Figure 4:
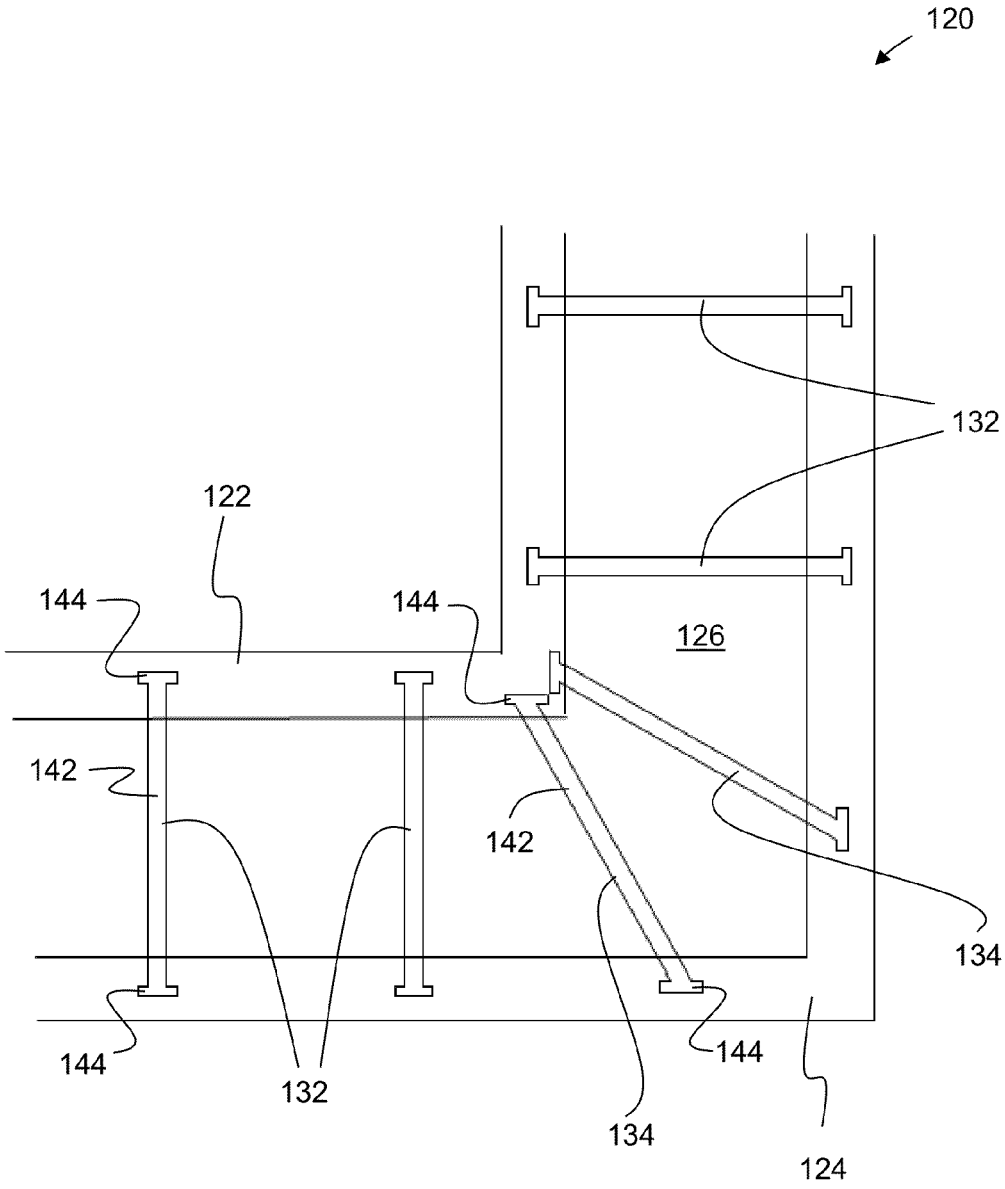
FIG. 4 is a sectional plan view of the insulating corner wall form of FIG. 2.
Figure 5:
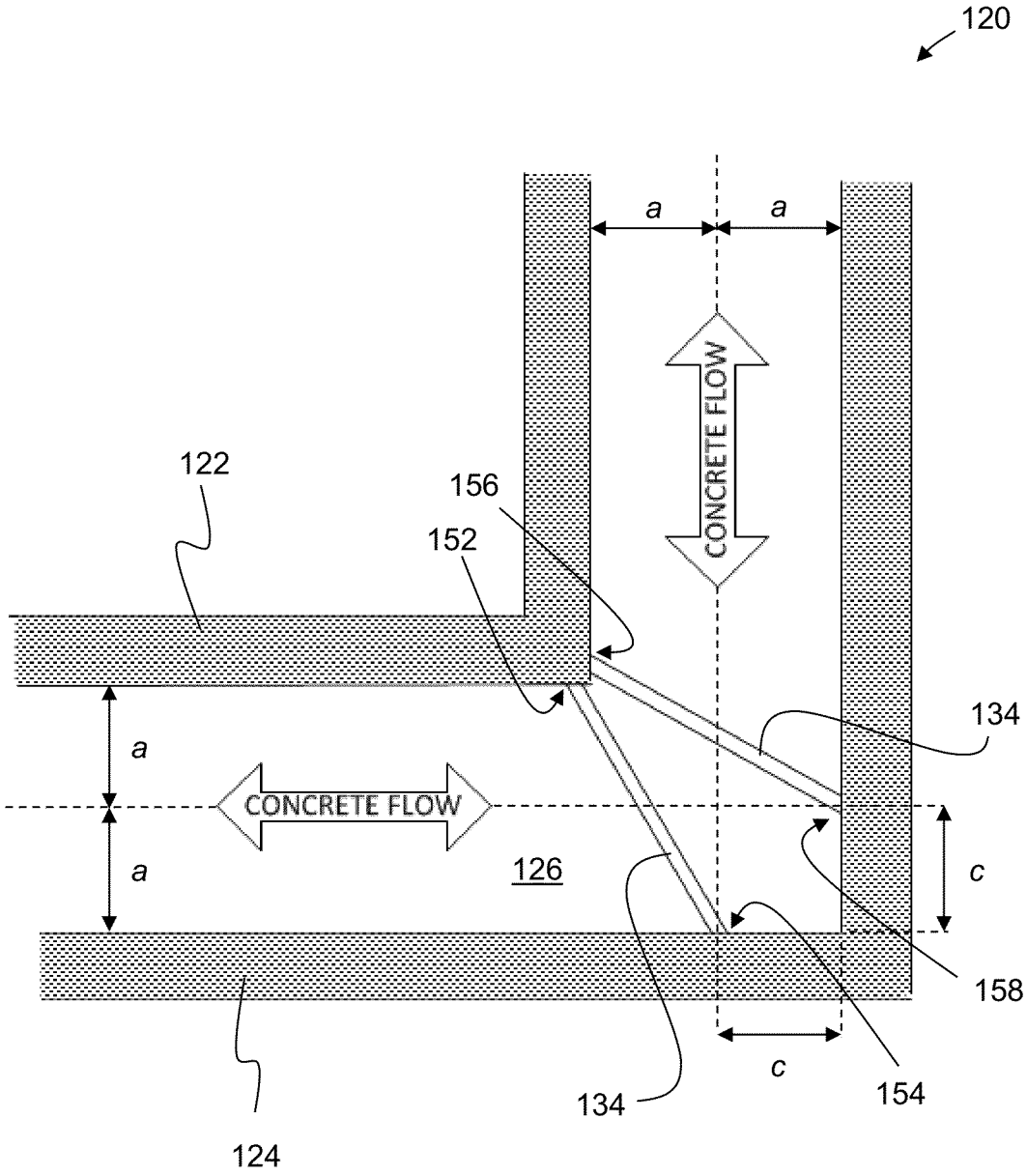
FIG. 5 is a schematic plan view of the insulating corner wall form of FIG. 2, showing directions of concrete flow during pouring.
Figure 6:
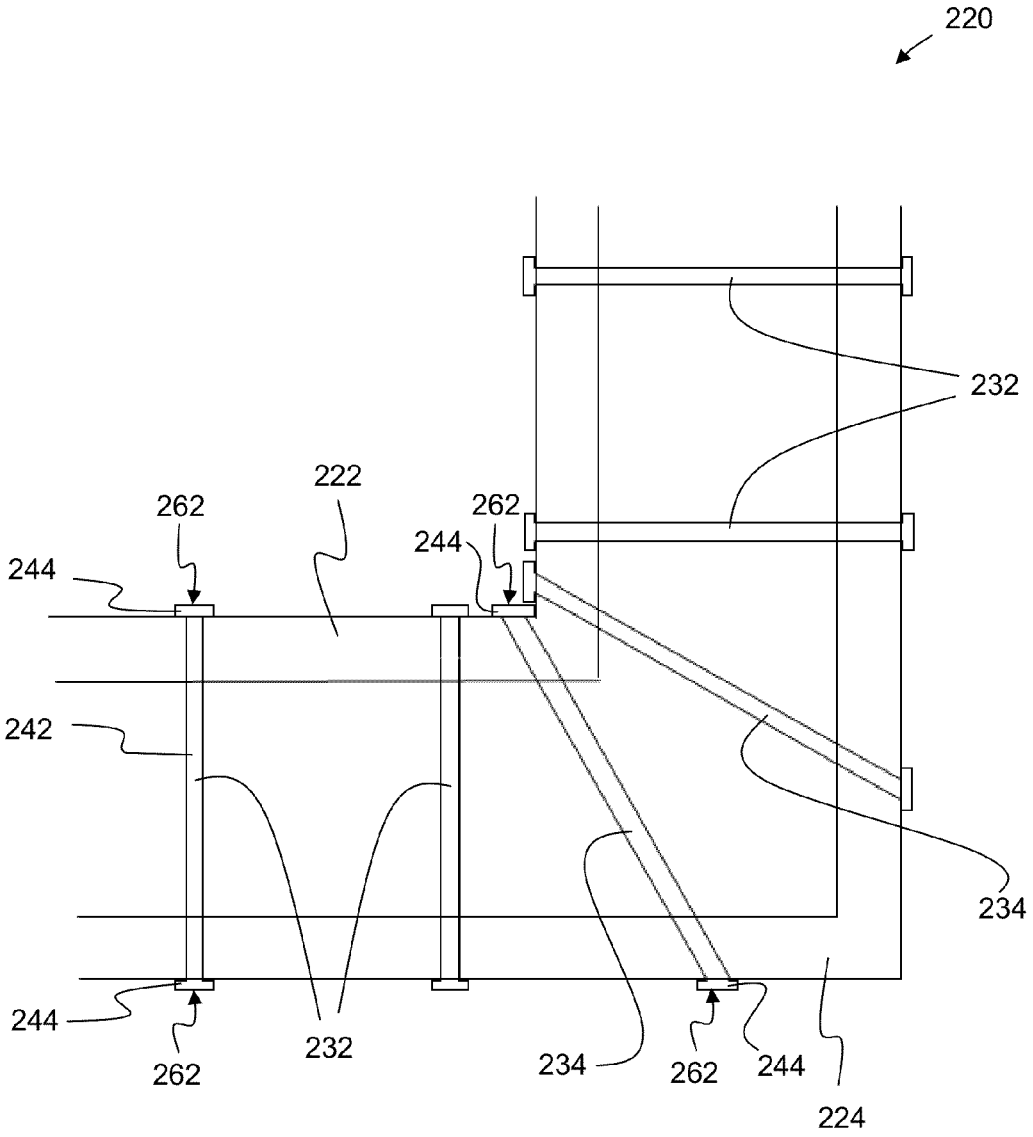
FIG. 6 is a sectional plan view of another embodiment of an insulating corner wall form.

In this embodiment, each corner tie 134 is generally identical to the tie 132, but comprises a longitudinal body of greater length, and also comprises flanged ends 144 that are angled relative to the longitudinal axis of the body, as may be seen in FIG. 4.

The form 120 comprises a first corner tie 134 that extends from a first location 152 at a concrete-facing surface of the inner panel 122, to a second location 154 at a concrete-facing surface of the outer panel 124. The form 120 also comprises a second corner tie 134 that extends from a first location 156 at the concrete-facing surface of the inner panel 122 to a second location 158 at the concrete-facing surface of the outer panel 124. As may the seen, the first locations 152 and 156 are proximate to, and on opposite sides of, the panel corner of the inner panel 122. Each of the second locations 154 and 158 is spaced a distance c from the panel corner of the outer panel 124. The distance c may be within the range of from about 20% to about 80% of the distance 2*a*. In this embodiment, the distance c is about 50% of the distance 2*a*.

In use, a form 120 is installed on site. A series of additional wall forms may be placed adjacent to the form 120, and/or additional forms 20 may be stacked upon the form 120, to assemble a form of larger size, as desired. Liquid concrete is then poured into the fixed space between the inner panel 122 and the outer panel 124. Depending on the pouring location(s) into the fixed space, the force of the liquid concrete may be greater at either the second location 154 of the first corner tie 134, or at the second location 158 of the second corner tie 134, or still alternatively may be poured from above into the fixed space immediately adjacent the corner such that the force of the liquid concrete is generally the same at the second locations 154 and 158 of the corner ties 134. The poured concrete is then allowed to set within the complete form, so as to form the concrete wall portion comprising a corner.

It will be understood that the corner ties 134 provide valuable reinforcement to the outer panel 124, as the distance c generally corresponds to the position on the concrete-facing surface of the outer panel 124 that is generally in-line with the concrete flow direction, and therefore directly receives a great deal of force from the weight of concrete during concrete pouring. Thus, the positioning of the corner ties 134 relative to the outer panel 124 advantageously render the form 120 less susceptible to breaking during concrete pouring, as compared to prior art insulating corner wall forms.

As will be appreciated, because the corner ties 134 are discrete components, and are separate from each other and each extend from a different respective location on the concrete-facing surface of the inner panel 122, they are generally mechanically independent of each other. As a result, in the event of a break occurring in the outer panel 124 during concrete pouring, the two (2) separate corner ties 134 would not together provide a single pivot point, and therefore any broken piece of the outer panel 124 would advantageously be less likely to pivot and cause the form to fail, as compared to prior art insulating corner wall forms.

In the embodiment described above, each flanged end of the tie (and an adjacent portion of the longitudinal body) is embedded within a respective one of the panels during molding of that panel. In other embodiments, other configurations are possible. For example, FIG. 7 shows another embodiment of an insulating corner wall form, which is generally indicated by reference numeral 220. Form 220 is generally similar to form 120 described above and with reference to FIGS. 2 to 5, and comprises an inner panel 222 and an outer panel 224 that are connected to each other by a plurality of longitudinal ties Inner panel 222 and outer panel 224 are generally identical to inner panel 122 and outer panel 124 described above. The ties connecting the inner panel 222 and the outer panel 224 comprise a plurality of ties 232 positioned along the parallel portions of the panels 222 and 224, and a plurality of corner ties 234 positioned adjacent the corners of the panels 222 and 224. The ties 232 and 234 are generally identical to the ties 132 and 134 described above and with reference to FIGS. 2 to 5, and each comprises a linear, longitudinal body 242 that is terminated by a pair of flanged ends 244, but has a longitudinal body of greater length than the tie 132 or 134. In this embodiment, a portion of the longitudinal body of each tie 232 and 234 is embedded within a respective one of panels 222 and 224 during molding of that panel. As may be seen, the ties 232 and 234 are sized such that a distal surface 262 of each flanged end 244 is positioned adjacent an outwardly-facing surface of each of the panels 222 and 224. As will be appreciated, the distal surfaces 262 are accessible from the outwardly-facing surface of each of the panels 222 and 224, and may be used to provide surfaces for mounting or attaching cladding and/or finishing panels to the outside of the form 220, such as drywall or siding. As will be understood, there may be additional ties positioned along the height of the panels 222 and 224 (that is, in the direction normal to the page).

Although in embodiments described above, each tie has a unitary construction comprising a linear, longitudinal body that is terminated by a pair of flanged ends, in other embodiments, one or more ties may alternatively have a non-unitary construction, and may alternatively comprise several elements that are either removably or permanently connected to each other. In one such embodiment, a non-unitary tie may comprise a first portion that is embedded within, and therefore encapsulated within, a respective panel during molding of that panel, and a second portion that is either removably or permanently connectable to the first portion. For example, the embedded first portion may be a flanged end, and the second portion may be a longitudinal body that is connectable to the embedded flanged end. It will be understood that other configurations of ties having non-unitary construction are possible.

Although in embodiments described above, the panels cooperate to form a corner having an angle of about 90 degrees, in other embodiments, the panels may alternatively form a corner having a different angle. It will be understood that insulating corner wall forms comprising corners having angles that are less than or greater than the angle of the embodiments described above could be constructed without departing from the purpose or scope of the invention disclosed herein.

Although in embodiments described above and shown in the drawings, parallel portions of the inner panel and outer panel are spaced from each other by a distance 2*a*, in other embodiments, the panels may alternatively be arranged such that first parallel portions of the inner and outer panels are spaced from each other by a first distance, and second parallel portions of the inner and outer panels are spaced from each other by a second distance, so as to define a fixed space therebetween having two (2) different thicknesses.

Although in embodiments described above, each of the panels has a unitary construction comprising two (2) linear portions that intersect to form a panel corner, in other embodiments, at least one of the panels may alternatively have a non-unitary construction, any may comprise two (2) or more separate linear portions that are joined to form a combined panel having a panel corner.

Although embodiments have been described above with reference to the accompanying drawings, those of skill in the art will appreciate that variations and modifications may be made without departing from the scope thereof as defined by the appended claims.

What is claimed is:

1. An insulating corner wall form comprising:

inner and outer foam panels arranged to provide a fixed space therebetween for receiving the poured concrete, the fixed space comprising a corner of about 90 degrees;

a plurality of ties connecting the inner and outer panels, the ties comprising:

first and second corner ties each extending from a respective first location at the inner panel to a respective second location at the outer panel, each second location being a distance from a panel corner of the outer panel of from about 20% to about 80% of the thickness of the fixed space between opposite parallel portions of the inner and outer panels, wherein the first locations are on opposite sides of a panel corner of a concrete-facing surface of the inner panel, and wherein at least one of the ties comprises a longitudinal body terminated by a pair of flanged ends, each flanged end being generally parallel with said opposite parallel portions of the inner and outer panels.

2. The insulating form of claim 1, wherein the second locations are on opposite sides of the panel corner of a concrete-facing surface of the outer panel.

3. The insulating form of claim 1, wherein each second location generally coincides with a line that generally bisects the fixed space between opposite parallel portions of the inner and outer panels.

4. The insulating form of claim 1, wherein each second location is a distance from the panel corner of the outer panel of from about 40% to about 60% of the thickness of the fixed space between opposite parallel portions of the inner and outer panels.

5. The insulating form of claim 1, wherein each second location is a distance from the panel corner of the outer panel of about 50% of the thickness of the fixed space between opposite parallel portions of the inner and outer panels.

6. The insulating form of claim 1, wherein at least one of the ties is embedded within a respective one of the inner and outer panels during molding of that panel.

7. The insulating form of claim 1, wherein said at least one tie has a unitary construction.

8. The insulating form of claim 1, wherein each flanged end is embedded within a respective one of the inner and outer panels.

9. The insulating form of claim 1, wherein said at least one tie is embedded within the inner panel such that a distal surface of said at least one tie is accessible from the outwardly-facing surface of the inner panel.

10. The insulating form of claim 1, wherein said at least one tie is embedded within the outer panel such that a distal surface of said at least one tie is accessible from the outwardly-facing surface of the outer panel.

11. The insulating form of claim 1, wherein the inner and outer panels are fabricated of expanded polystyrene (EPS).

12. The insulating form of claim 1, wherein at least one of the ties is fabricated of high-impact polystyrene (HIPS).

* * * * *